US008245785B2

(12) United States Patent
Peters

(10) Patent No.: US 8,245,785 B2
(45) Date of Patent: Aug. 21, 2012

(54) METHOD AND APPARATUS FOR LATERAL WELL DRILLING WITH BIASED LENGTH ADJUSTING CASING CUTTER

(75) Inventor: Jasper N. Peters, Millstadt, IL (US)

(73) Assignee: Latjet Systems LLC, Millstadt, IL (US)

( * ) Notice: Subject to any disclaimer, the term of this patent is extended or adjusted under 35 U.S.C. 154(b) by 366 days.

(21) Appl. No.: 12/423,574

(22) Filed: Apr. 14, 2009

(65) Prior Publication Data

US 2009/0255676 A1 Oct. 15, 2009

Related U.S. Application Data

(60) Provisional application No. 61/044,552, filed on Apr. 14, 2008, provisional application No. 61/044,639, filed on Apr. 14, 2008.

(51) Int. Cl.
*E21B 43/11* (2006.01)
*E21B 29/00* (2006.01)
*E21B 7/04* (2006.01)

(52) U.S. Cl. ..... 166/298; 166/55.2; 175/61

(58) Field of Classification Search ..... 166/222, 166/298, 308.1, 55.2; 175/62, 79, 61, 73, 175/76, 80, 67

See application file for complete search history.

(56) References Cited

U.S. PATENT DOCUMENTS

| | | | | |
|---|---|---|---|---|
| 2,500,252 | A * | 3/1950 | Ice | 175/78 |
| 2,539,047 | A * | 1/1951 | Arutunoff | 175/40 |
| 3,958,649 | A * | 5/1976 | Bull et al. | 175/61 |
| 4,693,327 | A * | 9/1987 | Dickinson et al. | 175/61 |
| 6,283,230 | B1 * | 9/2001 | Peters | 175/67 |
| 6,920,945 | B1 * | 7/2005 | Belew et al. | 175/67 |
| 2002/0108787 | A1 * | 8/2002 | Baird | 175/78 |
| 2008/0110629 | A1 * | 5/2008 | Belew et al. | 166/298 |
| 2010/0224367 | A1 * | 9/2010 | Brunet et al. | 166/298 |
| 2011/0147088 | A1 * | 6/2011 | Brunet et al. | 175/67 |

* cited by examiner

*Primary Examiner* — William P Neuder
*Assistant Examiner* — Michael Wills, III
(74) *Attorney, Agent, or Firm* — Matthews Edwards LLC

(57) ABSTRACT

The apparatus and method for drilling through the casing utilizes a yieldable biasing element to provide a self-adjusting length and exerts a predictable, controlled biasing force against the casing cutter for penetrating the casing. The cutter will be suspended from the well head by an element which will stretch to some extent, and the self-adjusting length will compensate for this also. As the cutter is lowered into position, and during the casing cutting operation, a flow of pressurized gas or emulsion can be directed through the down hole unit, to clear cuttings and other solids from the cutter's path.

16 Claims, 15 Drawing Sheets

PRIOR ART

METHOD AND APPARATUS FOR LATERAL WELL DRILLING WITH BIASED LENGTH ADJUSTING CASING CUTTER

This application claims the benefit of U.S. Provisional Patent Application Ser. Nos. 61/044,552 and 61/044,639, filed Apr. 14, 2008.

TECHNICAL FIELD

This invention relates generally to methods and apparatus for penetrating a side of a well casing for facilitating drilling into earth strata surrounding the well casing, and more particularly, to an improved method and apparatus for drilling through the casing, which utilizes a yieldable biasing element which provides a self-adjusting length capability, and which also exerts a predictable, controlled biasing force against the casing cutter for penetrating the casing.

BACKGROUND ART

The disclosure of Peters U.S. Pat. No. 6,283,230 entitled METHOD AND APPARATUS FOR LATERAL WELL DRILLING UTILIZING A ROTATING NOZZLE, issued Sep. 4, 2001, as well as the disclosures of my co-pending U.S. patent application Ser. No. 12/350,707, and U.S. Provisional Patent Application Ser. Nos. 61/044,552 and 61/044,639, filed Apr. 14, 2008, are hereby incorporated herein by reference in their entireties.

A large number of wells have been drilled into earth strata for the extraction of oil, gas, and other material therefrom. In many cases, such wells are found to be initially unproductive, or decrease in productivity over time, even though it is believed that the surrounding strata still contains extractable oil, gas or other material. Such wells are typically vertically extending holes including a casing usually of mild steel pipe having an inner diameter of from just a few inches to about eight (8) inches or more in diameter for the transportation of the oil, gas or other material upwardly to the earth's surface.

In an attempt to obtain production from unproductive wells and increase production in under producing wells, as well as for improving production from wells generally, methods and apparatus for cutting a hole in the well casing and forming a lateral passage therefrom into the surrounding earth strata are known. Reference for instance, my previous Peters U.S. Pat. No. 6,283,230, which utilizes a down hole unit including a casing cutter in a first step for cutting the hole in the casing, and a flexible tube carrying a nozzle through which fluid is discharged for drilling the lateral passage as a second step. Both are advanced laterally from down hole apparatus, e.g., a kick-off shoe unit supported in the well by a rigid tube, the casing cutter being advanced against the casing, and the flexible tube and nozzle through the hole through the casing and into the lateral passage as the passage is increased in length.

The kick-off shoe unit has an internal passage or elbow connecting with a laterally facing opening through which the casing cutter and flexible tube extends during the casing cutting and lateral passage forming operations, respectively. The casing cutter is attached to the end of a string or series of universal joints, or other flexible device, configured and suspended from a rotatable output shaft of a motor, so as to be received through an upper opening of the elbow of the shoe and so as extend through the elbow of the shoe to the inner surface of the casing. A tubular sheath is suspended from the output shaft and contains and protects the cutter and universal joints during the descent through the tubing down to the kick-off shoe.

The motor is suspended from flexible tubing within the larger diameter rigid outer tube, and is lowered through the outer tube until the cutter contacts the inner surface of the casing, causing the flexible tubing to slacken, which signals to the operator that the cutter is in the cutting position in contact with the casing. The operator will then adjust the tension in the flexible tubing to hold the cutter against the casing with a sufficient force to cut through the casing. Here, it has been found that the flexible tubing will have a significant amount of resilience or elasticity which can amount to as much as several feet of stretch due to the long length thereof, which can vary from as little as a few hundred feet to as much as several thousand feet depending on the depth of the well, which makes it difficult to accurately gauge the contact force between the cutter and the side of the casing. As a result, typically, when the operator determines that the cutter is properly positioned and the desired cutting force is present, the motor will be operated for a period of time estimated to be adequate for fully penetrating the casing. The cutter is then retrieved and examined for characteristics, e.g., worn consumable shim, indicative of full penetration of the casing.

As the casing cutter is cutting the casing, it has been found that no direct feedback is provided to the operator at the surface of the well. As the cutter advances, there is not a perceptible change at the top of the well, in the position of the tubing supporting the cutting apparatus, as a result generally of the above noted elasticity of the suspended apparatus. Typically also, the portion of the weight of the suspended flexible tubing, motor, and drilling apparatus, not supported from above provides the cutting force, which force can thus vary widely as a function of operator experience, and the depth of the well and length of tubing required, which can be a shortcoming in the use of this apparatus.

Accordingly, what is sought is a solution to the above shortcoming, by providing a more uniform and predictable cutting force.

SUMMARY OF THE INVENTION

What is disclosed is apparatus and a method for providing a more uniform and predictable cutting force when cutting a well casing at a depth within a well, and which provides other advantages, set forth below.

According to a preferred aspect of the invention, a motor operable for rotating the cutter is suspended from flexible tubing and configured to be lowered into a well to a location just above the kick-off shoe. The motor includes elements for locking in a motor housing supported above the shoe. The motor has a rotatable output shaft carrying cutting apparatus comprising the casing cutter, a series of universal joints, and a resiliently compressible biasing element constructed and operable according to the invention. These elements are preferably arranged such that the biasing element is disposed between the motor output shaft and the uppermost universal joint, with the cutter connected to the lowest joint. Preferably, a second length of shaft or shaft extension is disposed between the biasing element and the uppermost universal joint, such that the universal joints will be largely disposed only within a lower curved region of the elbow or curved passage through the kick-off shoe. The motor output shaft and biasing element are preferably housed in a non-rotating tubular extension extending down from the non-rotating body or casing of the motor, and the shaft extension extends downwardly through a non-rotating, tubular sheath extending down from the tubular extension. The universal joints and cutter, in turn, extend down from the sheath. The cutter and universal joints are sized and shaped to be receivable within the elbow or other passage through the shoe.

According to another preferred aspect of the invention, the lower end of the sheath is configured to mate with the upper end of the shoe, to align the interior of the sheath with the upper end of the elbow through the shoe, such that the interiors of the extension of the motor, sheath and the elbow will form a continuous passage of known length. This will also position the motor a known distance from the shoe. The cutting apparatus, e.g., output shaft, biasing element (in its uncompressed state), shaft extension, universal joints, and cutter will have a predetermined length. This length will be selected so as to be greater than the distance from the motor through the extension, sheath and elbow through the shoe, plus the estimated maximum distance from the lateral opening of the shoe to the inside surface of the casing. Here, it should be noted that this distance is part of a space or gap commonly referred to as the annulus between the inside surface of the casing and the exterior of the shoe, and the lateral extent or which at a particular location around the circumference of the casing may not be accurately known.

As the motor and attached cutting apparatus are lowered within the well to the shoe, the cutter and universal joints will be lowered into the elbow, and the universal joints will articulate and bend as they follow the cutter through the bend of the elbow. As the bottom of the sheath approaches the top of the shoe, the cutter will emerge from the lateral opening of the shoe, and contact the side of the casing. With continued lowering of the sheath, the bottom of the sheath will align and mate with the upper end of the shoe, forming a fixed length enclosed passage from the motor to the lateral opening of the shoe. At the same time, because the length of the cutting apparatus before compression of the biasing element is greater than the distance to the inner wall of the casing, the biasing element will be compressed by about the amount the length is greater. This will also result in application of a force by the cutter against the casing surface, as a result of the transfer of some of the weight of the cutting apparatus, motor and flexible tubing to the cutter. But, the spring constant or other indicator of the compressibility of the biasing element, will be selected such that the bulk of this weight will be transferred to the shoe, via the sheath. The motor will also lock non-rotatably into a motor housing segment of the outer tube.

With the motor and other elements supported mainly by the shoe via the sheath, the stretch or resiliency of the flexible tubing will be removed as a substantial factor in the force applied by the cutter against the inner surface of the casing. In this regard, the compression of the biasing element provided by the invention is important, as it will regulate the cutting force applied by the cutter for penetrating the casing, and it will also facilitate the ability of the apparatus to compensate for differences between the length of the cutting apparatus (from motor to end of cutter) and the distance through the extension, sheath, elbow and portion of the annulus between the lateral opening of the elbow and the opposing side surface of the casing. For instance, if the cutting apparatus is 1.5 inches longer than the distance through the extension, sheath, elbow and annulus, the biasing element will be compressed by that amount. The cutting apparatus is thus essentially made self-adjusting in length, and largely self regulating in terms of the applied cutting force.

Advantages of the present apparatus include that the cutting force will be consistent and applied in a predictable manner, regardless of operator skill and well depth, so as to be at least generally uniform from hole to hole, to provide predictable and reliable casing penetration.

The preferred cutting apparatus construction includes a biasing element which is a compression spring, retained between an upper retainer on an upper segment of the motor output shaft, and a lower retainer which is movable up and down on the upper segment of the output shaft and rotatable therewith. The lower retainer is captured or retained by the extension of the motor case or body. The extension also supports the sheath. An extension shaft connects to the lower retainer for rotation therewith, and, in turn, is connected to and supports the series of universal joints. The combined length of the output shaft, biasing element, and shaft extension, will extend about from the motor to the upper end of the bend of the elbow. A swivel can be provided between the lower retainer and the extension shaft, to facilitate insertion of the cutter and universal joints into the shoe, and aligning of the sheath with the shoe.

As another preferred aspect of the invention, the sheath includes at least one hole therethrough for the passage of a pressurized gas or emulsion into the sheath, so as to pass through the sheath into the elbow of the shoe, so as to be discharged from at least the laterally facing opening in a manner for limiting entry of cuttings, particulates, including abrasive particles if used for cutting through the casing and/or the strata, and other solids into the laterally facing opening and the elbow.

The pressurized gas or emulsion will preferably be a compressed air, carbon dioxide, nitrogen or another inert gas, or a combination of these, and will be discharged during the cutting of the casing and also the drilling of the lateral passage through the formation. The gas or emulsion can also be used at other times, as required for maintaining the lateral opening and elbow clear of matter. As an option, the pressurized gas or emulsion can also be discharged from one or more additional outlets, that can be located as desired or required, for directing the cuttings away from the lateral opening of the shoe, and more preferably upwardly from the shoe, so as to be carried by upward fluid flow to the surface of the well.

All of the gas or emulsion can be discharged from the shoe or the vicinity of the shoe, or some of it can be discharged from an orifice or orifices, at one or more higher locations within the well, for boosting the cuttings flow upwardly through the well, and also for reducing or removing the hydrostatic head within the well.

As another feature of the invention, the extension of the motor case or body can be connected in a manner, e.g., a threaded connection, which allows adjusting the length thereof, for varying the position of the motor above the shoe, and thus the length by which the cutter will extend from the shoe to contact the inner surface of the casing, and also the amount of compression of the biasing element, as desired or required for a particular application.

DETAILED DESCRIPTION OF THE INVENTION

Figure 1:
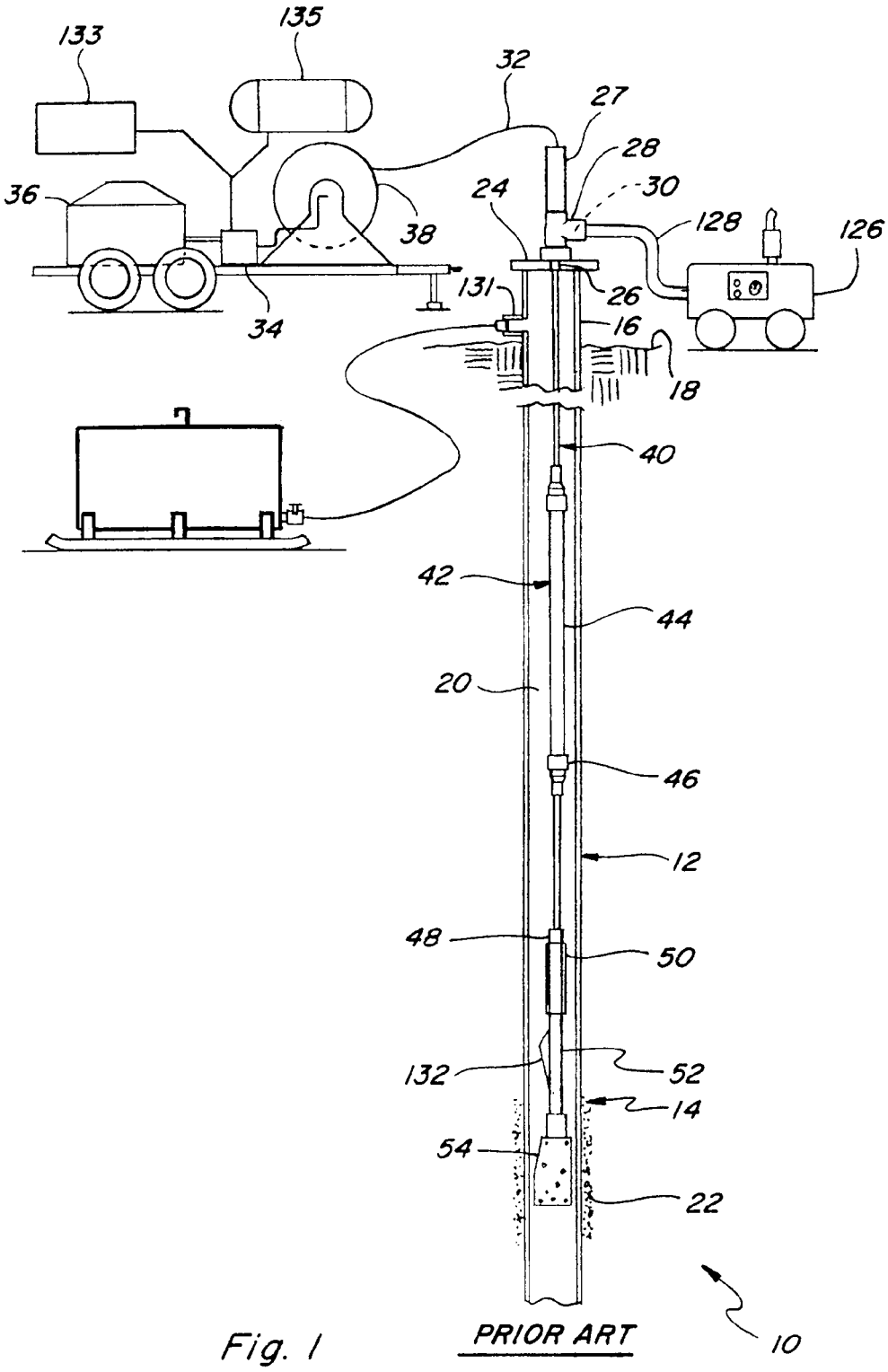
Fig. 1 PRIOR ART
FIG. 1 is a side elevational view showing a well in fragmentary cross section and apparatus according to my prior invention therein in position for penetrating the well casing thereof.
Figure 2:
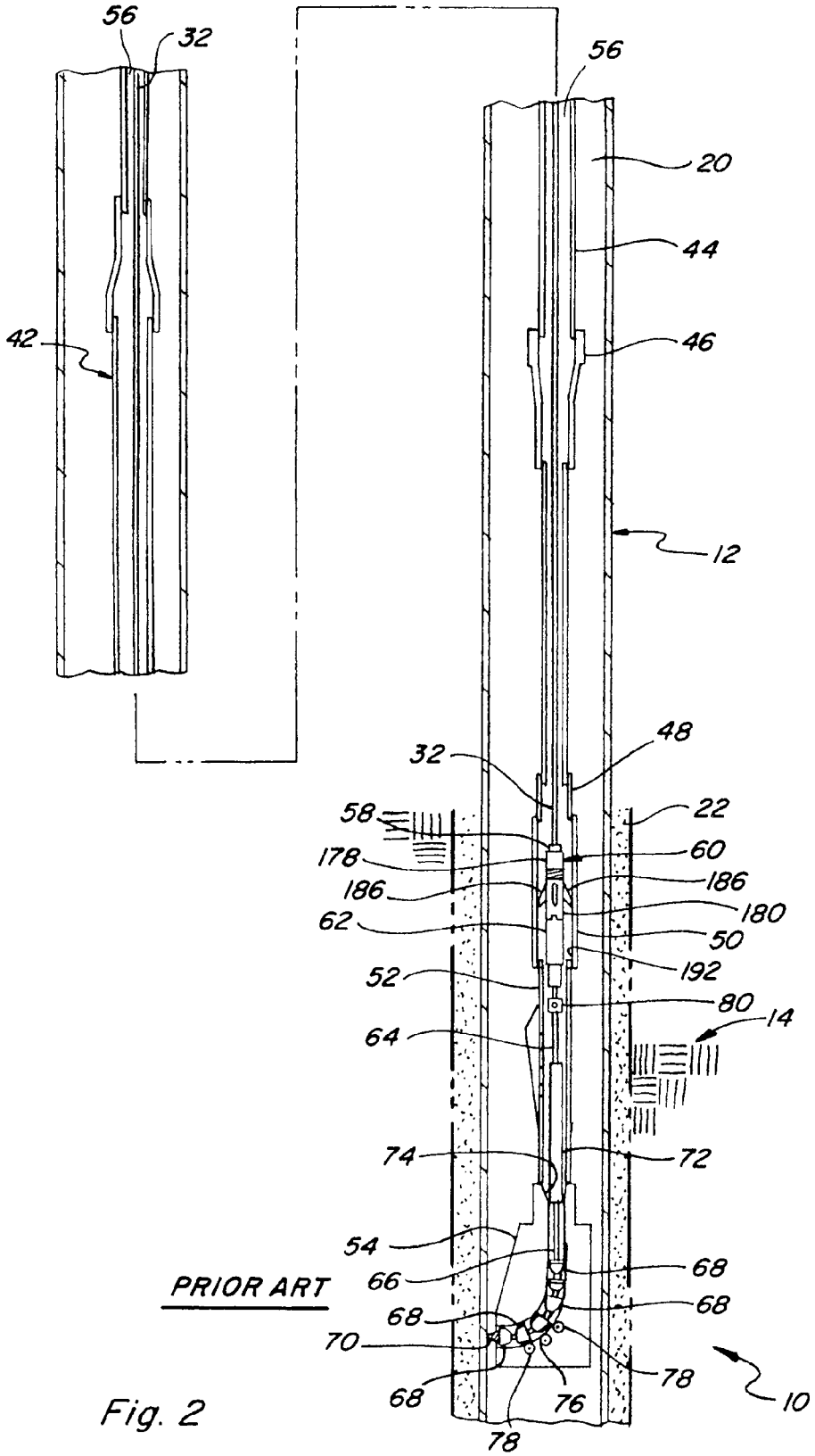
FIG. 2 is a side elevational view of the well and apparatus of FIG. 1 in partial cross-section showing the apparatus being used to form a hole through the casing.

FIGS. 1 and 2 show apparatus 10 constructed and operable according to my previous invention of Peters U.S. Pat. No. 6,283,230, for penetrating a well casing 12 and surrounding earth strata 14. As explained in that patent, well casing 12 consists of steel piping extending from a well head 16 on or near the earth's surface 18 downwardly through strata 14 into a formation therein which hopefully contains oil and/or gas. Well casing 12 is of conventional construction defining an interior passage 20 of from between about 4 to about 8 inches in diameter and from several hundred to several thousand feet in depth. Cement or other material 22 is typically located around well casing 12 to hold it in place and prevent leakage from the well. Well head 16 includes a cap 24 having an opening 26 therethrough communicating passage 20 with a conventional oil saver device 27, and a tee 28 including an access port 30.

Apparatus 10 includes a quantity of flexible tubing 32 adapted for holding fluid under pressure sufficient for drilling the formation, and additionally casing 12, if apparatus 10 is appropriately configured to provide a casing cutting capability, e.g., using abrasives delivered against the casing via a nozzle. As non-limiting representative operating pressures, pressure of as high as about 10,000 psi have been used for wells at depths of about 2000 feet from the surface, and higher pressures such as about 15,000 psi can be used for drilling at greater depths. The fluid under pressure is supplied by a pump 34 connected to a fluid source 36 such as a city water supply, a water tank or the like. Flexible tubing 32 is stored on a reel 38 from which the tubing is fed into a length of more rigid tubing 40 which extends a desired distance down through interior passage 20 of casing 12 to a desired elevation below the earth's surface. Tubing 40 terminates in passage 20 of casing 12 at a coupling with a down hole unit 42 suspended in passage 20 by tubing 40. According to one embodiment with which the present invention can be used, down hole unit 42 includes a tubular motor housing 44, an upper receiving tube 46 and a kick-off shoe unit 48. Kick-off shoe unit 48 is shown including a tubular casing drill receiving unit 50, an air jet tube 52 and a bottom-most kick-off shoe 54. Tubing 40 and down hole unit 42, including motor housing 44, upper receiving tube 46, and all of the above discussed components of kick-off shoe unit 48 remain in the position shown down hole in casing 12 throughout operation of apparatus 10.

Flexible tubing 32 extends through a cavity 56 extending through tubing 40 and down hole unit 42, and terminates at a coupler 58 shown supporting a casing drill unit 60 in FIG. 2. Casing drill unit 60 includes a fluid driven motor 62 connected in fluid communication with flexible tubing 32. Motor 62 is constructed essentially as shown in FIG. 9A, and in the configuration shown in FIG. 2, is connected to an output shaft 64 operatively rotatable thereby and including a terminal end 66 supporting a plurality of universal joints 68 for rotation therewith, including an end most universal joint 68 having a conical shaped casing cutter 70 mounted thereto for rotation therewith. As an alternative to using a casing cutter such as cutter 70, the apparatus of the invention can use an abrasive stream for penetrating casing 12. A protective sheath 72 is also mounted about output shaft 64 and defines an inner cavity (not shown) for containing and protecting universal joints 68 and casing cutter 70 as those members are lowered through cavity 56 of tubing 40 and down hole unit 42. Sheath 72 will be modified as taught by my present invention, as will be explained below. According to my previous invention, as casing drill unit 60 is lowered through cavity 56, sheath 72 will come into abutting relation with a beveled edge 74 within kick-off shoe 54 thus stopping downward travel of the sheath, while casing cutter 70 and universal joints 68 will proceed into shoe 54, travel around an elbow 76 therein, such that casing cutter 70 will come as shown to rest against the inner surface of casing 12. In this regard, shoe 54 includes a plurality of rollers 78 to facilitate travel of cutter 70 and universal joints 68 through elbow 76, and output shaft 64 includes a swivel 80 for alignment purposes.

Figures 2A, 2B:
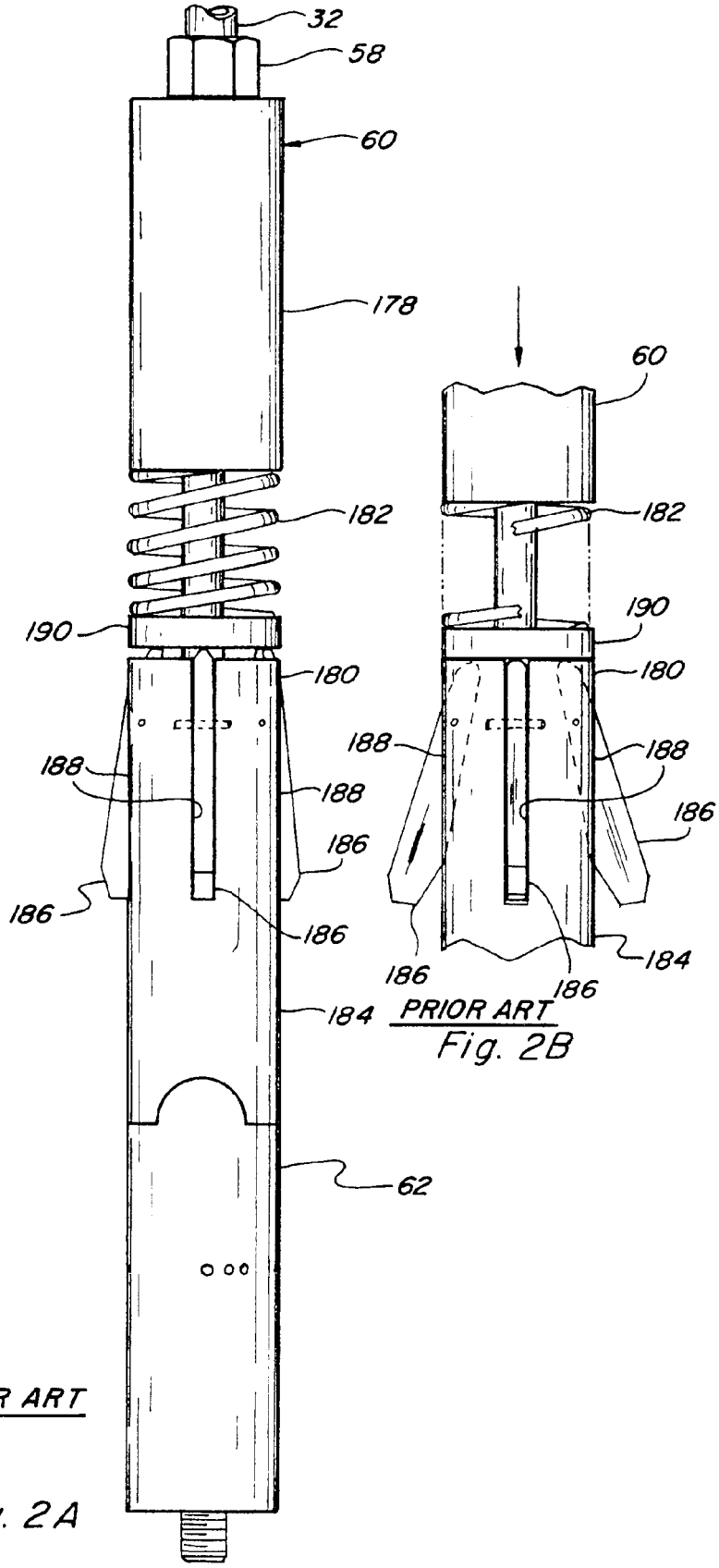
Fig. 2B PRIOR ART
FIG. 2A is a fragmentary enlarged fragmentary side view of the apparatus of FIG. 1.
FIG. 2B is another enlarged fragmentary side view of the apparatus of FIG. 1.

Also referring to FIGS. 2A and 2B, casing drill unit 60 of my prior invention additionally includes an upper portion 178 connected to flexible tubing 32 via coupler 58, and a spring loaded dog assembly 180 disposed between upper portion 178 and motor 62. Dog assembly 180 includes a compression coil spring 182 disposed between upper portion 178 and a dog housing 184 including a plurality of dogs 186 pivotally mounted in slots 188 at angularly spaced locations around housing 184. Dogs 186 are resiliently urged radially outwardly by a spring 182 retained by a spring retainer 190, for engaging a splined inner circumferential surface 192 of casing drill receiving unit 50 for preventing rotating of casing drill unit 60 therein. Then, as one alternative, after the casing drilling operation is completed as explained next, and casing drill unit 60 is withdrawn from receiving unit 50, dogs 186 retract to allow passage upwardly through the upper portion of down hole unit 42 and tubing 40.

Figure 3:
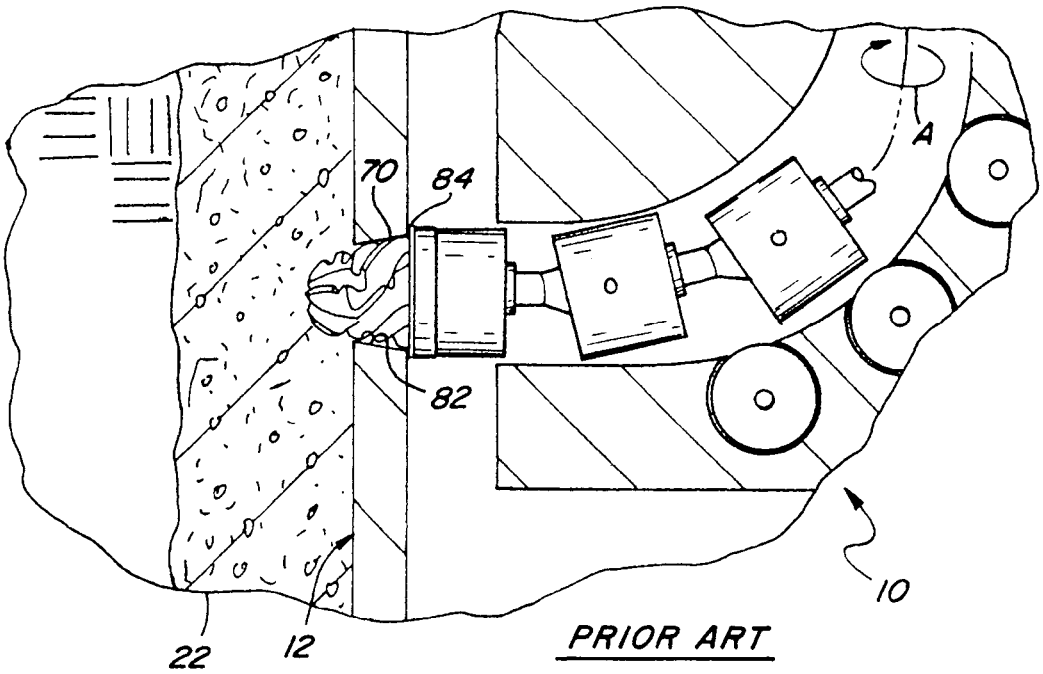
FIG. 3 is an enlarged fragmentary sectional view of the well and apparatus of FIG. 1 showing the completed hole through the casing.

Referring also to FIG. 3, rotation of casing cutter 70 of apparatus 10 as shown by arrow A, by motor 62 while urged against the inner surface of casing 12 results in casing cutter 70 cutting through casing 12, producing a hole 82. Desirably, an annular drill stop 84 extends around casing cutter 70 at a predetermined location spaced from the tip thereof to prevent casing cutter 70 from cutting substantially past casing 12 into cement 22. Upon formation of hole 82, operation with casing drill unit 60 is complete, and that unit can be withdrawn from down hole unit 42 and tubing 40.

Figure 3A:
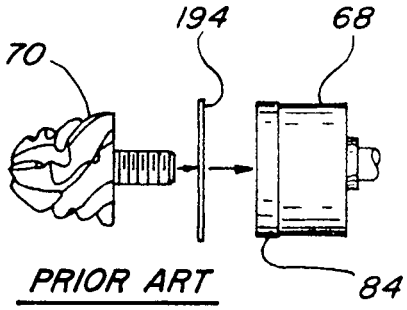
FIG. 3A is an exploded side view of a cutter of the apparatus of FIG. 1.

Referring to FIG. 3A, a consumable shim 194 is disposed between cutter 70 and drill stop 84 which is mounted to endmost universal joint 68. Shim 194 is damaged by rotating contact with the inner surface of casing 12 and importantly can be inspected after withdrawal of unit 60 from casing 12 for verify that hole 82 has been properly formed.

Figure 4:
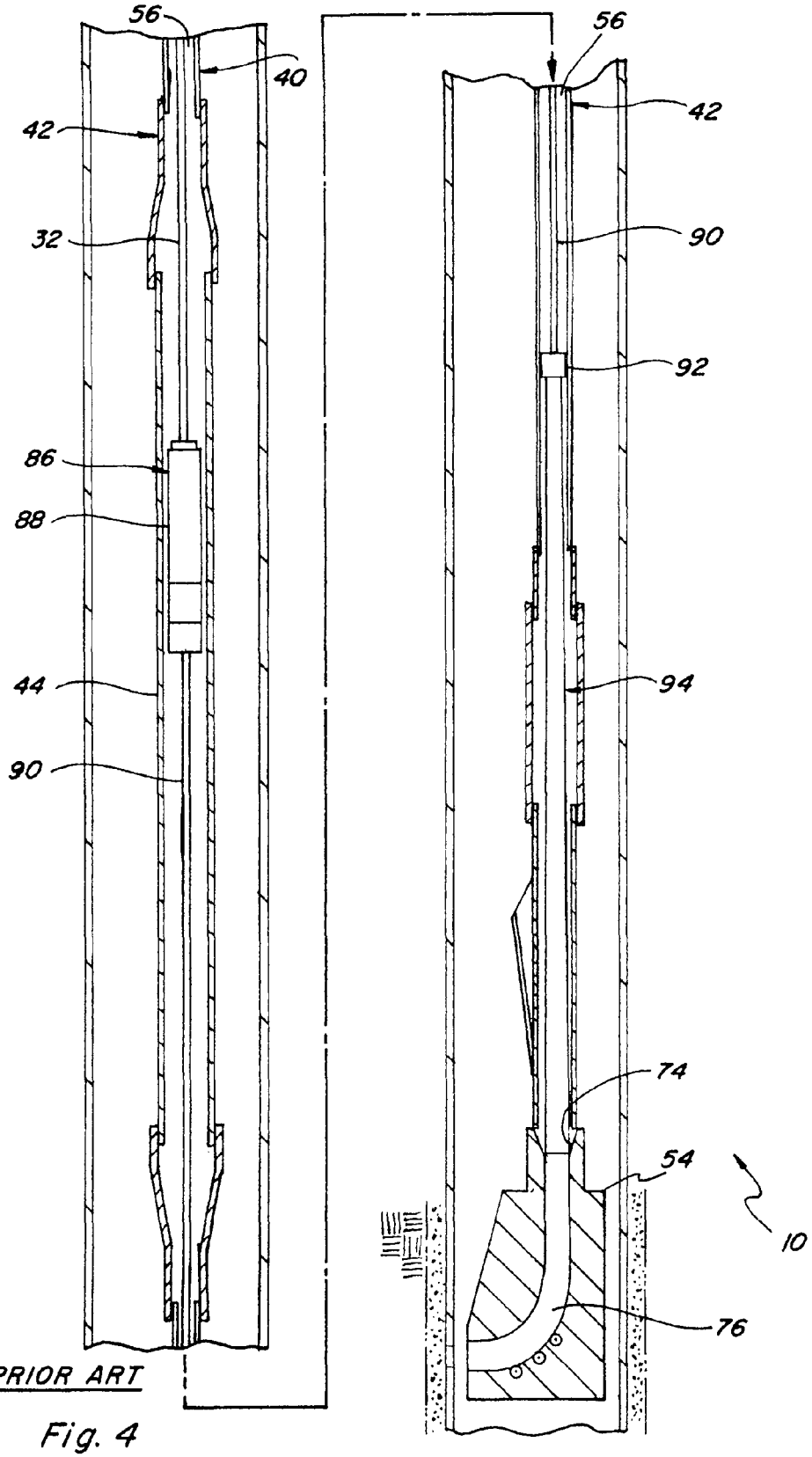
PRIOR ART Fig. 4
FIG. 4 is a fragmentary side elevational view in section showing apparatus according to my prior invention for drilling strata surrounding the well casing.

Referring to FIG. 4, after withdrawal of casing drill unit 60, a strata drill unit 86 of apparatus 10 is mounted to flexible tubing 32 and lowered through cavity 56 of tubing 40 and down hole unit 42 to kick-off shoe 54. Strata drill unit 86 includes a fluid driven motor 88 located in motor housing 44, motor housing 44 having an inside cross-sectional shape at least marginally larger than the outer cross-sectional shape of motor 88, as will be discussed. A rigid tube 90 is connected to motor 88 for rotation thereby. Rigid tube 90 terminates at an upper end 92 of a set down device 94.

Figure 5:
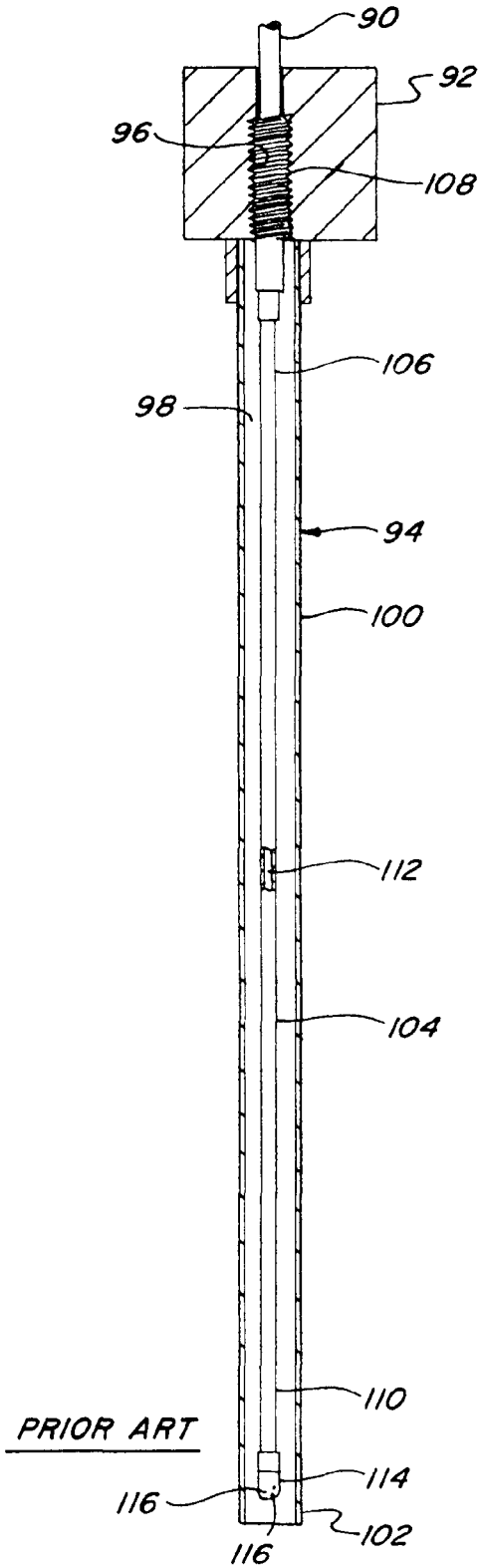
FIG. 5 is a fragmentary side view in partial cross-section of the apparatus of FIG. 4.
Figure 5A:
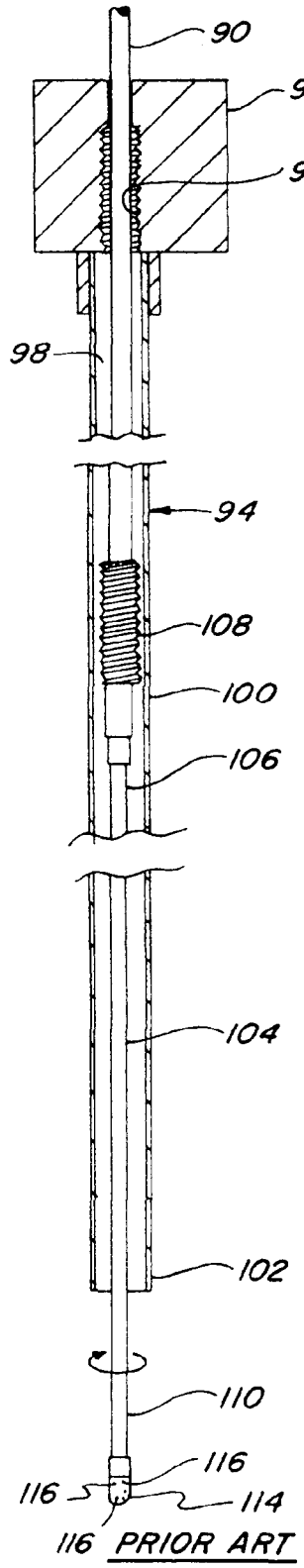
FIG. 5A is a fragmentary side view of the apparatus of FIG. 4 in an extended position.

Referring also to FIGS. 5 and 5A, set down device 94 includes a threaded passage 96 extending therethrough and communicating with an internal passage 98 of a rigid tubular sheath 100. Sheath 100 includes a bottom most terminal end 102 positionable in abutment with beveled edge 74 of kick-off shoe 54 for positioning internal passage 98 in communication with elbow 76 (FIG. 4). A flexible tube 104 has an upper end 106 mounted to rigid tube 90 for rotation therewith by an externally threaded coupler 108 adapted for threaded engagement with set down device 94 in threaded passage 96. When coupler 108 is threadedly engaged with set down device 94, flexible tube 104 is located and protected within internal passage 98 of sheath 100. Flexible tube 104 includes a lower end 110 opposite upper end 106, and an internal passage 112 therethrough connecting upper end 106 with lower end 110. A nozzle 114 is mounted to lower end 110 of tube 104 in fluid communication with internal passage 112. Nozzle 114 includes a plurality of apertures 116 therethrough.

Referring more particularly to FIGS. 4, 5 and 5A, motor 88 is operable to rotate rigid tube 90 to threadedly disengage coupler 108 from threaded passage 96 of set down device 94 to allow nozzle 114 and lower end 110 of flexible tube 104 to drop beneath sheath 100, for entering elbow 76 of shoe 54.

Figure 6:
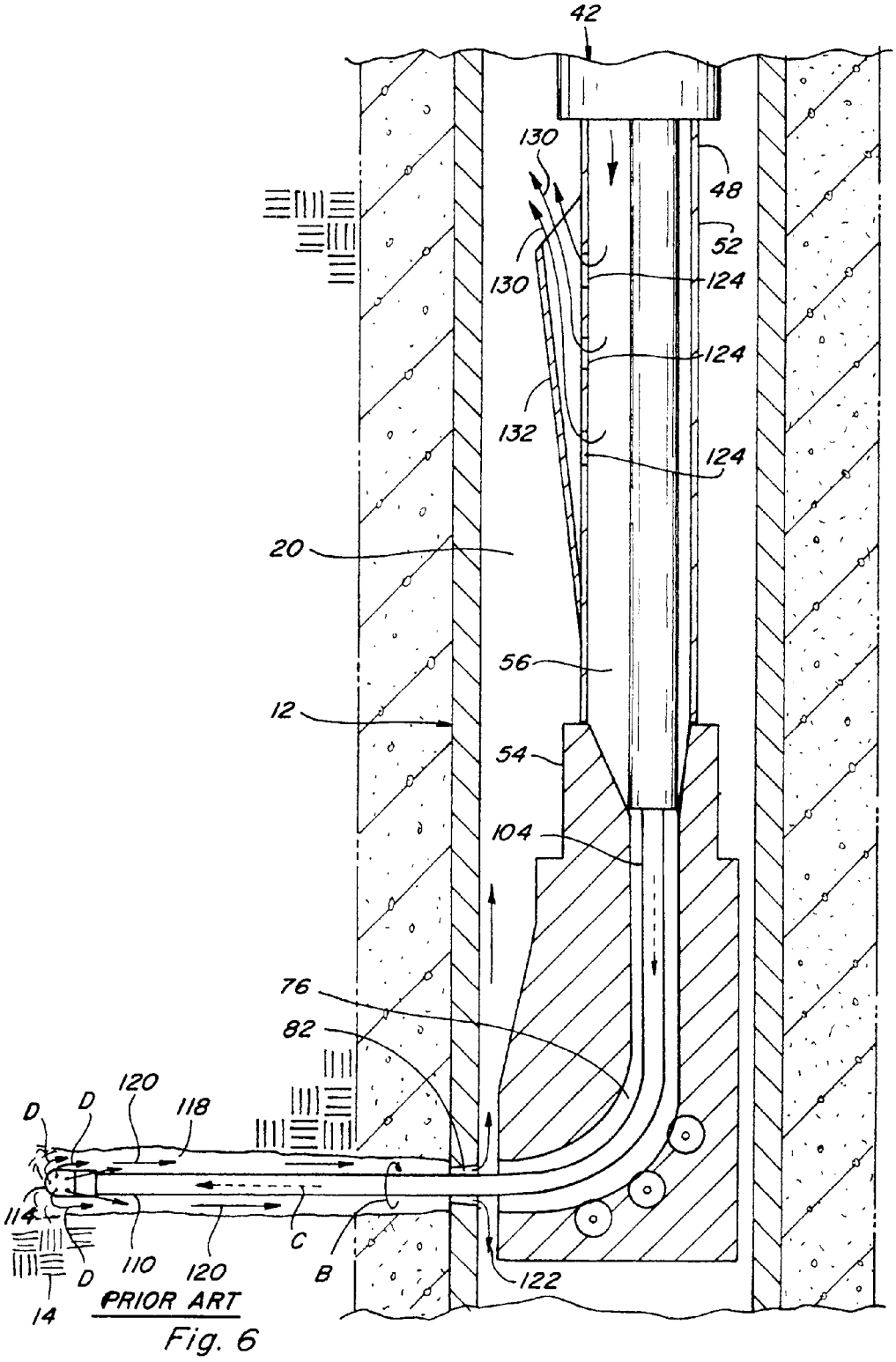
FIG. 6 is a fragmentary side elevational view of the apparatus of FIG. 4 drilling an extension of the hole of FIG. 2 into the strata and reducing a hydrostatic head over the hole.

Turning to FIG. 6 as flexible tube 104 is continually lowered, lower end 110 and nozzle 114 will pass through elbow 76 of shoe 54 and into hole 82 through casing 12, hole 82 having a slightly tapered shape corresponding to the shape of casing cutter 70. As nozzle 114 advances through hole 82, it is rotated as denoted by the arrow B by motor 88 (FIG. 4) and fluid from fluid source 36 is pressurized by pump 34 (FIG. 1) and communicated to nozzle 114 through motor 88, rigid tube 90 (FIG. 4), and flexible tube 104, as denoted by the arrow C. The fluid under pressure is discharged from nozzle 114 through apertures 116 against cement and strata 14 lying beyond hole 82, as denoted by the arrows D. The fluid under pressure impinging the cement and/or strata 14, in combination with the rotation of nozzle 114, operates to loosen and dislodge particles to thereby drill an extension 118 of hole 82 into the cement and/or strata 14. Additionally, a fluid flow as shown by the arrows 120 is created by the discharged fluid for carrying the particles through extension 118 and hole 82 so as to be discharged into interior passage 20 of casing 12 as denoted by arrow 122.

During the strata drilling step, it has been found that if a hydrostatic head having a pressure greater than the formation pressure in extension 118 is present above the drilling location, for instance, resultant from the addition of water or liquid from the strata drilling operation to the column of liquid normally present in casing 12, liquid will be absorbed into the formation or strata around nozzle 114 and flexible tube 104, so as to stop the fluid and particle flow denoted by arrows 120. For instance, it has been found when attempting to drill an extension 118 at a depth of about 2500 feet below the earth's surface and with a hydrostatic head which has greater head pressure than the formation pressure, little to no drilling progress could be made, which is believed largely due to limitations on particle and fluid flow 120 caused by the hydrostatic head.

One approach to mitigate the above discussed problems relating to a large hydrostatic head, as described in my previous patent, utilizes an air jet tube 52 having a plurality of air jets 124 communicating internal passage 56 extending through tubing 40 and down hole unit 42 with interior passage 20 of casing 12. According to a preferred approach of the invention explained below, a stream or flow of pressurized gas or an emulsion of a gas and a liquid such as a drilling foam is directed into passage 20 from the lateral opening of elbow 76 and/or another opening or openings in the vicinity of the lateral opening. This has the added advantage of also preventing particulates and solids, e.g., cuttings, and abrasives if used, from entering the lateral opening and thus the elbow. The stream or flow of the gas or emulsion can be directed in any suitable direction for carrying the cuttings away, but it is most preferred to direct or carry the cuttings upwardly, and from the well, in the manner disclosed in my prior patent for removing liquid from the well for reducing the hydrostatic head therein. In this way, the cuttings and/or other particles or solids, will only minimally collect in the openings and passages of the down hole apparatus and the bottom of the well, and will be easier to remove. Referring back to FIG. 1, a compressor 126 is located on surface 18 and includes a high pressure line 128 connected through access port 30 with internal passage 56. Compressor 126 is conventionally operable to compress air and direct the air through high pressure line 128 into internal passage 56 wherein the pressurized air travels downwardly and will enter the sheath through a suitable passage or passages, so as pass through elbow 76 and be discharged into interior passage 20. Thus, the flow of gas or emulsion performs two tasks, removing or reducing the hydrostatic head, and keeping cuttings, abrasives and other particulates out of elbow 76.

Here, it should be noted that periodically during the strata drilling step, air or gas under pressure can be injected into flexible tubing 32 so as to be discharged through apertures 116 of nozzle 114, for clearing any debris or blockage that may be present therein and for clearing accumulated debris from extension 118. A suitable pressure for the air or gas has been found to be about 2,000 psi or greater, and it can be injected by a high pressure compressor 133 or other suitable device connected to tubing 32 at pump 34 as shown or at another suitable location. This is believed to be effective because with the reduction of the hydrostatic head in the well, when the air or gas under pressure enters extension 118 the air or gas will expand and move at high velocity toward casing 12 to urge the cuttings from the extension. When this operation is performed, it will be essential to prevent the cuttings and other particles leaving the lateral passage from entering elbow 76 where they can cause problems.

Figure 7:
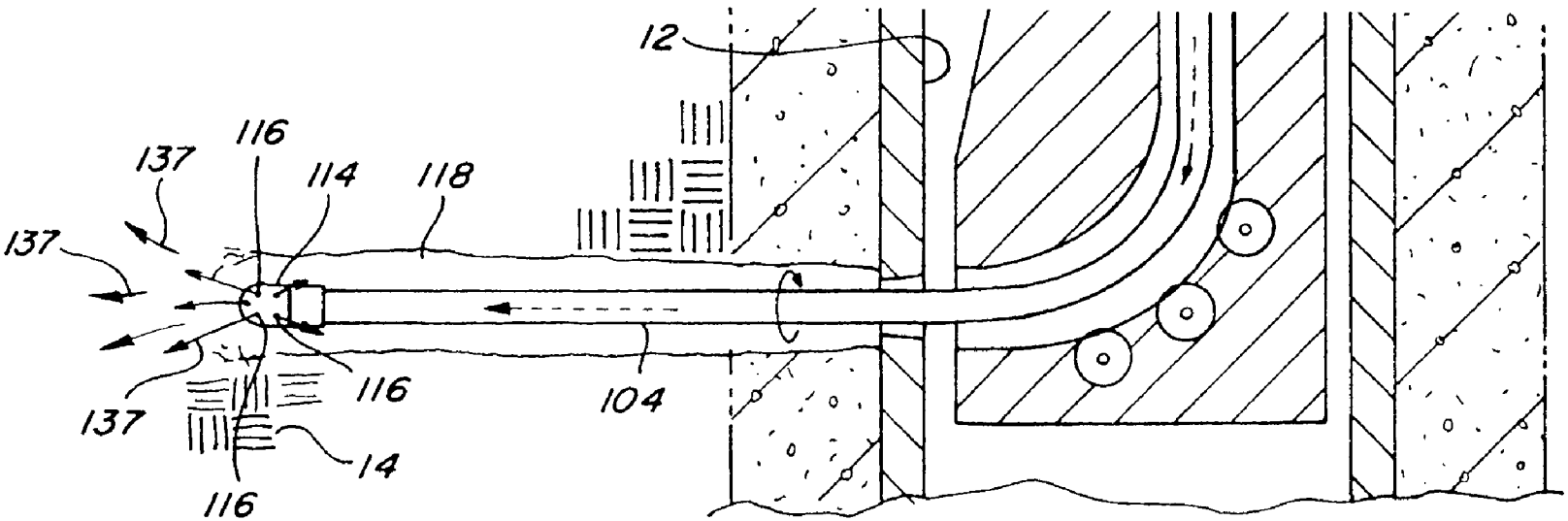
PRIOR ART Fig. 7
FIG. 7 is a fragmentary side elevational view of the apparatus of FIG. 4 showing an acid or a gas being injected into the extension of FIG. 6.

Referring to FIGS. 1 and 7, after extension 118 has been drilled to a desired extent, the delivery of air into the lower region of the well casing can be stopped, to allow the hydrostatic head to again build up. Then, once the hydrostatic head is sufficiently high, an acid, mixture of acid and another substance, or a gas contained in a tank 135 on the earth's surface 18 can be injected into flexible tubing 32 under pressure supplied by compressor 133, pump 34 or another suitable device, so as to be conveyed through flexible tube 104 to nozzle 114 and discharged through apertures 116 thereof into strata 14 surrounding extension 118. This has been found to be an advantageous procedure, as the acid, mixture or gas is delivered in a pristine condition to the strata surrounding extension 118, for etching or otherwise reacting with alkaline materials in the strata, for increasing the production potential at that location. Here, the presence of the hydrostatic head has been found to provide a pressurized condition in well casing 12 which is sufficient to maintain the acid or gas localized within extension 118 where it is desired.

Figure 8:
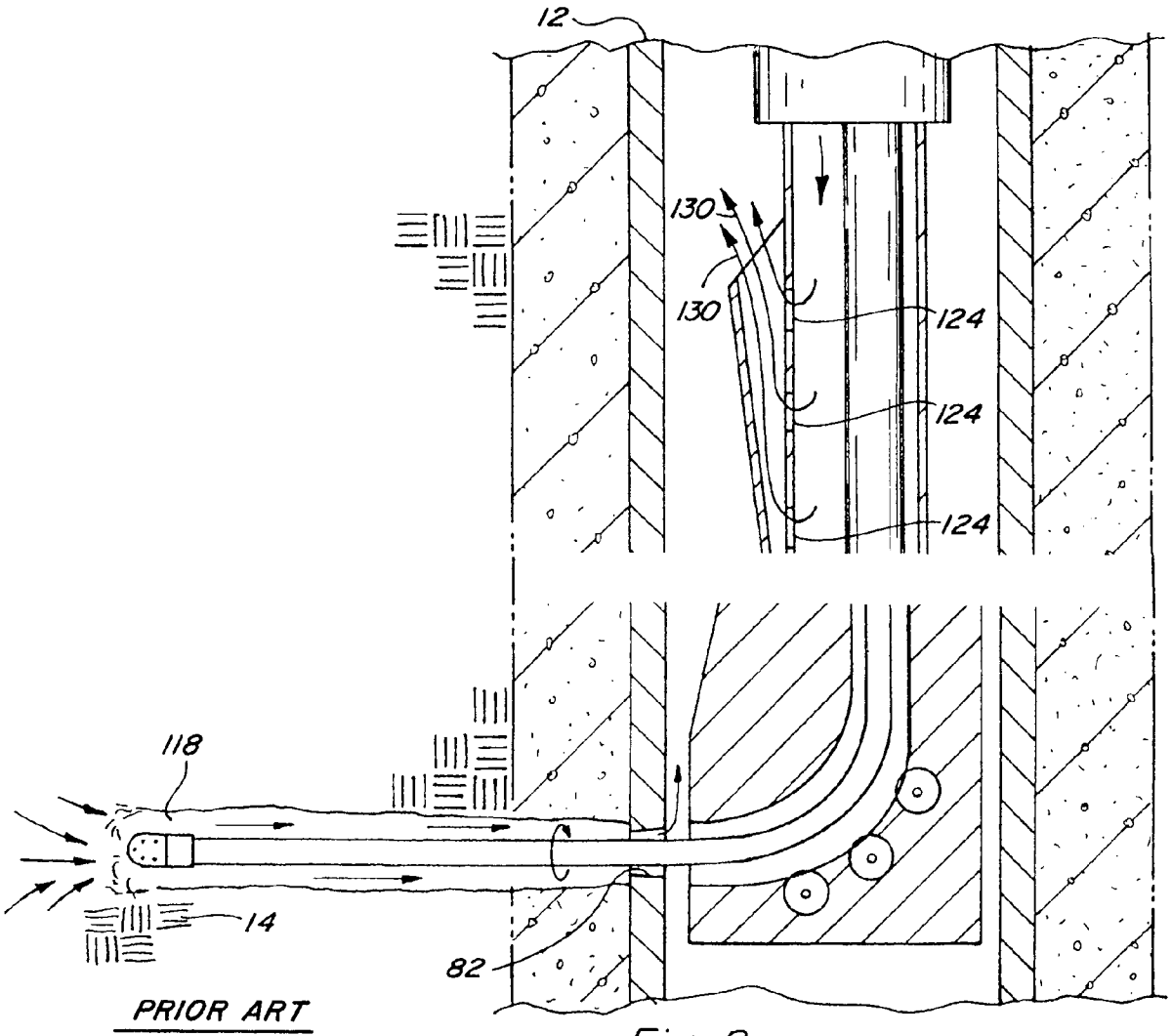
Fig. 8 PRIOR ART
FIG. 8 is a fragmentary side elevational view of the apparatus of FIG. 4 showing flow of material from the extension during reduction of the hydrostatic head.

Referring also to FIG. 8, after a sufficient period of time for the acid or gas to perform its desired function has elapsed, the hydrostatic head can be reduced by pumping a gas such as air or an emulsion through elbow 76 in the below-described manner, such that the acid, gas and/or reaction products can flow from the strata 14 in the vicinity of extension 118, through hole 82 and into casing 12, wherein those materials can be carried by the pressurized air to well head 16. Here, it should be noted that by pumping the gas or emulsion through elbow 76, entry and build-up of particles such as cuttings, abrasives and the like in elbow 76 can be avoided. At well head 16 the material can exit casing 12 through access port 131 and be collected in a suitable repository, such as the storage tank illustrated. There, the material can be examined to ascertain the success of the acid or gas injection to determine whether drilling and/or injection should be continued.

As explained in my previous patent it is important to drill extension 118 in the strata so as to be of sufficient size and unobstructed to allow the advancement of nozzle 114 and flexible tube 104 therethrough. This can be achieved by rotation of flexible tube 104 and nozzle 114 using motor 88, or possibly by other means, such as by generating a rotating fluid stream other than by rotation of the nozzle and tube.

Figure 9:
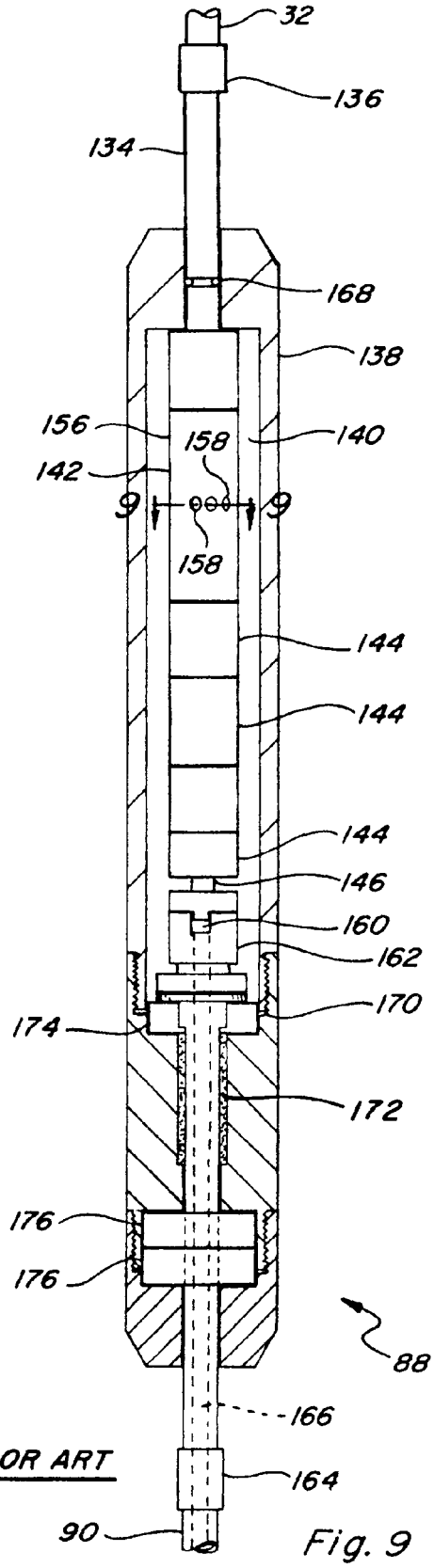
FIG. 9 is a side elevational view of the apparatus of FIG. 4 in partial cross-section.
Figure 9A:
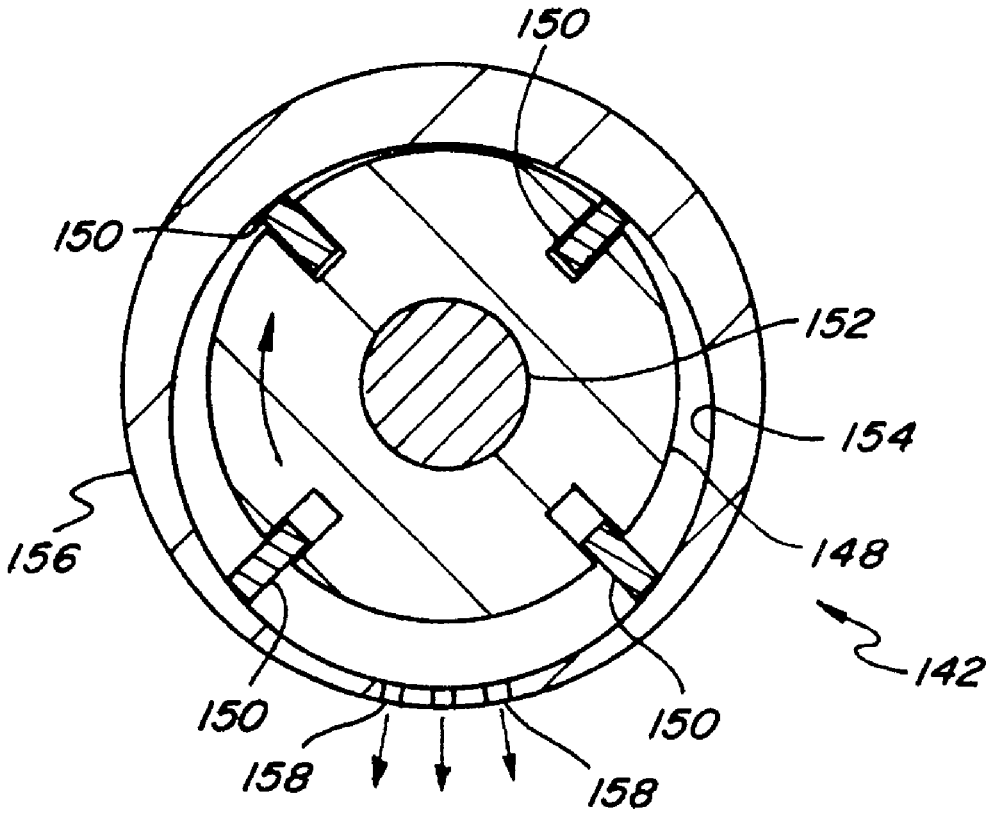
PRIOR ART Fig. 9A
FIG. 9A is a cross-sectional view taken along line 9-9 of FIG. 9.
Figure 10:
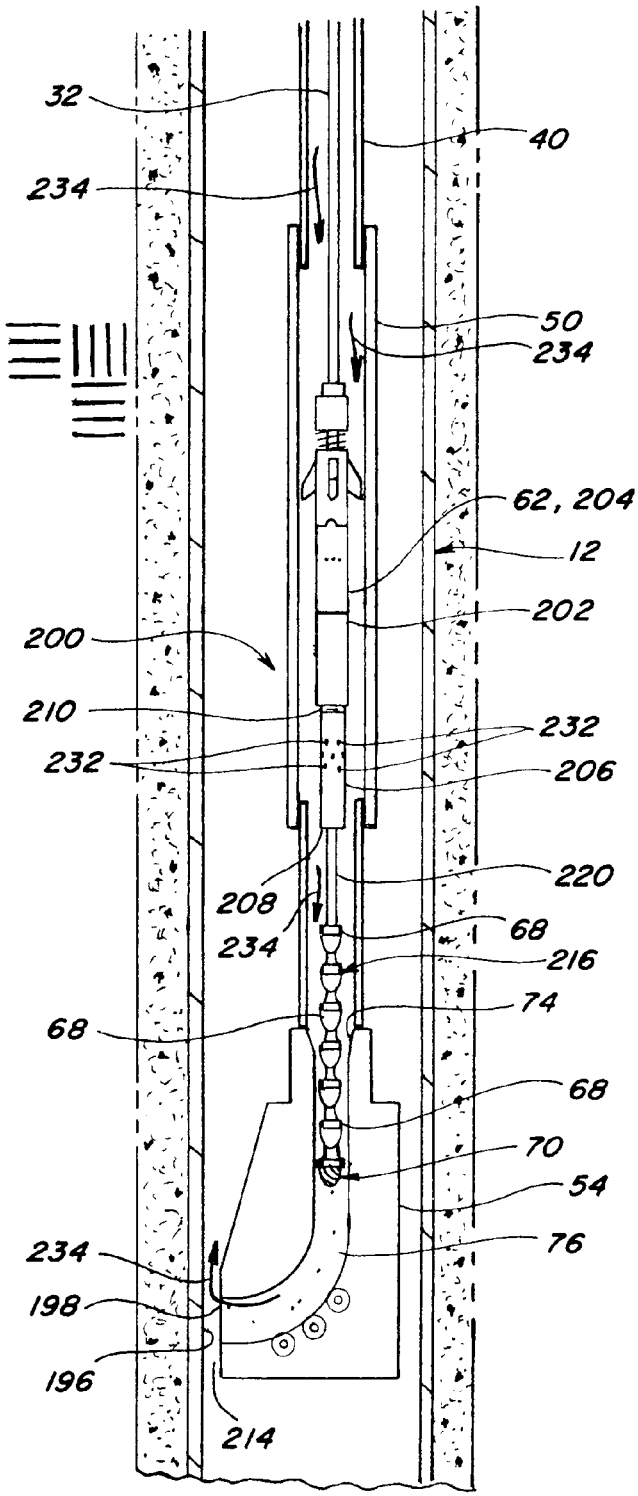
FIG. 10 is a fragmentary side view in partial cross-section of down hole aspects of the apparatus of FIG. 1, modified to include an embodiment of apparatus of the present invention, showing the apparatus of the invention down hole in a well and inserted partially into the kick-off shoe.
Figure 11:
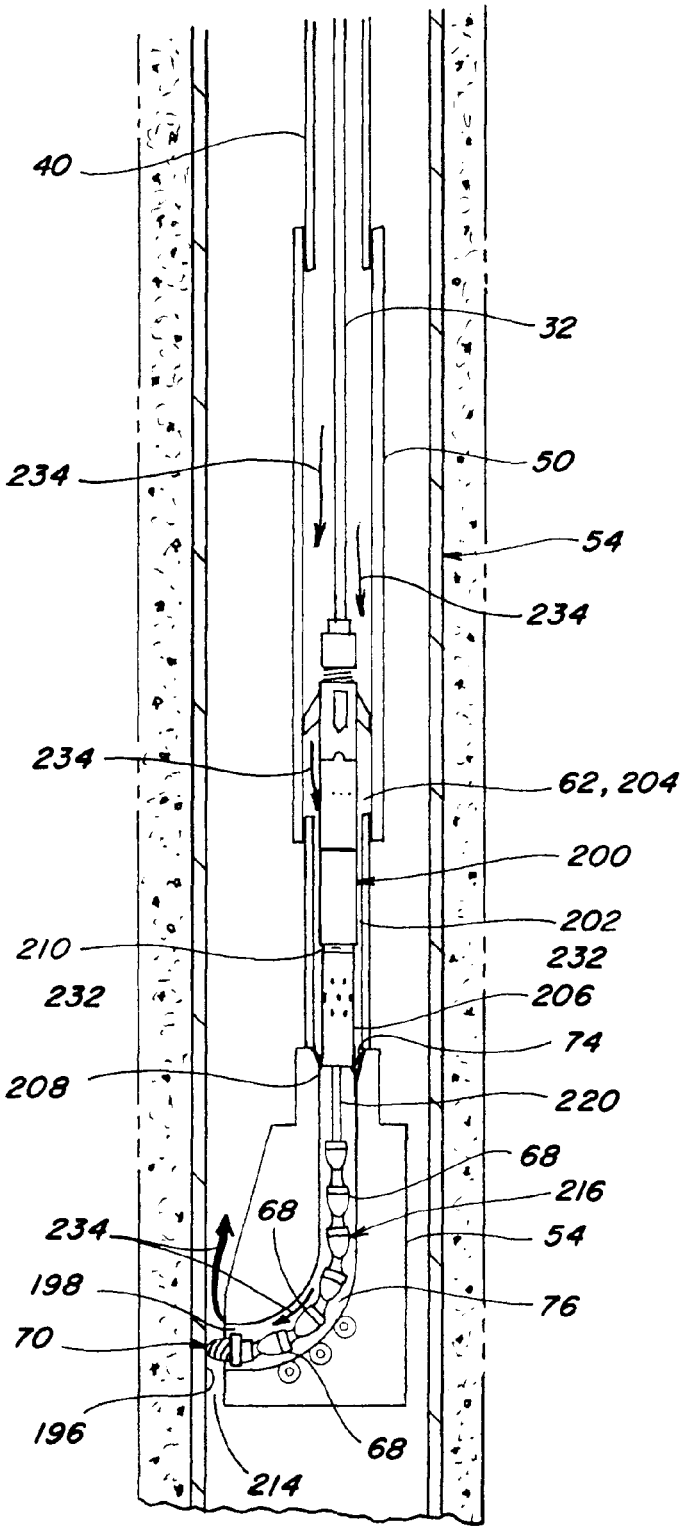
FIG. 11 is another fragmentary side view in partial cross-section of the apparatus of FIG. 10, shown fully inserted into the shoe with the cutter against the inner surface of the casing of the well, and showing compressed fluid routing through the apparatus and discharge therefrom.

Turning to FIG. 9, motor 88 is shown. Motor 88 includes an inlet nipple 134 coupled in fluid communication with tubing 32 by a coupler 136 for receiving pressurized fluid from pump 34 therethrough. Coupler 136 also supports motor 88, rigid tube 90, flexible tube 104 and nozzle 114 (See FIGS. 6 and 7). Motor 88 includes an outer case 138 defining an internal cavity 140 containing a fluid motor unit 142 connected in driving relation to a plurality of gear reducers 144, including a final gear reducer having an output shaft 146 driven by fluid motor unit 142. Referring also to FIG. 9A, fluid motor unit 142 is a vane type fluid motor having an eccentric 148 including a plurality of radially moveable vanes 150 of solid brass, copper or other substantially rigid material. Motor 62 discussed above is constructed essentially the same. Motor unit 142 is connected in driving relation to a drive shaft 152 for relative eccentric rotation to an inner circumferential surface 154 of an inner case 156 under force of pressurized fluid received through inlet nipple 134. The fluid is then discharged from inner case 156 through discharge ports 158 into internal cavity 140 wherein the pressurized fluid travels to an inlet port 160 of a hollow motor output shaft 162. Output shaft 162 passes through outer case 138 and is coupled to rigid tube 90 by a coupler 164. Output shaft 162 includes an internal passage 166 thus connected in fluid communication with internal passage 112 through tube 90 and tube 104, for delivering the pressurized fluid to nozzle 114.

As noted above, the pressurized fluid carried through tubing 32 to motor 88 can be at a pressure of as high 10,000 psi or greater. To enable motor assembly 88 to withstand and contain such pressures without significant leaking, an O-ring 168 is located around inlet nipple 134, a second O-ring 170 extends around the juncture of two parts of outer case 138, and a series of O-rings or packing 172 extend around motor output shaft 162 as it passes through case 138. Additionally, a thrust bearing 174 and ball bearings 176 are provided in association with output shaft 162 for the smooth rotation of tubes 90 and 104, and nozzle 114.

Referring again to FIGS. 2 and 3, when cutting casing 12, cutter 70 is urged against the casing by a portion of the weight of at least flexible tubing 32 and casing drill unit 60, the remainder of the weight being carried by apparatus at the surface. As a result of the great length of tubing 32, and the elasticity of that tubing, as well as friction between universal joints 68 and the interior surfaces of shoe 54, it can be difficult to accurately gauge the actual force exerted by cutter 70 against casing 12. It is also difficult, if not impossible, to determine when casing 12 has been fully penetrated. As a result, it is a common practice to operate motor 62 for a period of time deemed adequate for penetrating the casing, which period of time can be, for instance, about one hour or so. Disadvantages of this practice include that the cutting force can vary from well to well, between different human operators, as a result of a variety of other conditions.

Referring also to FIGS. 10, 11, 12 and 13, the present invention provides an improved casing drill unit 200 for penetrating casing 12 at a location on inner surface 196 thereof opposite a laterally facing opening 198 of shoe 54. Casing drill unit 200 includes a tubular motor housing extension 202 of known length fixedly mounted to the lower end of a body 204 of motor 62 so as to extend downwardly therefrom about output shaft 64 of motor 62. As result, extension 202 and body 204 are non-rotating, while output shaft 64 will be rotated by operation of motor 62, as driven by pressurized fluid delivery thereto as explained above. A hollow tubular sheath 206 having a known length is fixedly mounted to a bottom end of extension 202, and has a lower terminal end 208. The lower end of extension 202 and upper end of sheath 206 are preferably matingly engageable, for instance, utilizing a threaded coupling 210, to allow disassembly thereof, and replacement of sheath 206 with a different sheath, for instance, one having a different length, or other features, and also for allowing adjusting the position of sheath 206 relative to extension 202. The interiors of extension 202 and sheath 206 are jointed to form a continuous passage 212 therethrough which is open at lower terminal end 208 of the sheath. Additionally, terminal end 208 of sheath 206 is sized and shaped so as to be matingly engageable with beveled edge 74 of shoe 54, preferably, for forming a sealed condition therebetween, and such that passage 212 is in communication with the interior of elbow 76.

When these components are assembled, passage 212 is extended from motor 62, through extension 202, sheath 206 and elbow 76 of shoe 54, to laterally facing opening 198 on the side of the shoe. Because the lengths of extension 202 and sheath 206 are known, the distance from motor 62 to shoe 54 will be the sum of these lengths. The distance from the top of shoe 54 through elbow 76 to laterally facing opening 198 in the side of the shoe will also be known, such that the total distance through passage 212 and elbow 76 from the motor to the laterally facing opening will be known. Additionally, an approximation of the width of the portion of an annulus 214 between laterally facing opening 198 and opposing inner surface 196 of casing 12 will be made.

Output shaft 64 of motor 62 preferably carries cutting apparatus 216 comprising casing cutter 70, a series of universal joints 68, a resiliently compressible biasing element 218 (FIG. 12), and a shaft extension 220 (optional), constructed and operable according to the invention. These elements are preferably arranged such that biasing element 218 is disposed between output shaft 64 and the uppermost universal joint 68, with cutter 70 connected to the lowest joint 68. Preferably, shaft extension 220 (if used) is disposed between biasing element 218 and uppermost universal joint 68, such that universal joints 68 will be largely disposed generally within a lower curved region of elbow 76 of shoe 54, when the cutting apparatus is received therein. Output shaft 64 and biasing element 218 are preferably housed in passage 212 within extension 202, and shaft extension 220 extends downwardly through the passage and beyond sheath 206. Universal joints 68 and cutter 70, in turn, are located below extension shaft 220. Cutter 70 and universal joints 68 are sized and shaped to be receivable within elbow 76 of shoe 54 as before.

Importantly, output shaft 64 and cutting apparatus 216, that is, biasing element 218 (in its uncompressed state), shaft extension 220, universal joints 68, and cutter 70, will have a predetermined overall length, selected so as to be greater than the combined length of passage 212 from motor 62 through sheath 206, elbow 76 through shoe 54, and the estimated maximum extent of the portion of annulus 214 between inner surface 196 of casing 12 and laterally facing opening 198 of the shoe. As a result, when drill unit 200 including motor 62 and attached cutting apparatus 216 are lowered within the well to shoe 54, cutter 70 and universal joints 68 will be lowered into elbow 76, and universal joints 68 will articulate and bend as they follow cutter 70 through the bend of the elbow. As the bottom of sheath 206 approaches the top of the shoe, cutter 70, because of the length of cutting apparatus 216, will emerge from laterally facing opening 198 of the shoe, and contact inner surface 196 of casing 12. With continued lowering of unit 200, terminal end 208 of sheath 206 will align and mate with tapered inner surface 74 of shoe 54, forming the above discussed fixed length enclosed passage 212 from motor 62 to elbow 76 and ending at laterally facing opening 198. At the same time, biasing element 218 will be resiliently compressed to accommodate this. Motor 62 will also lock non-rotatably into receiving unit 50 of tubing 40.

With sheath 206 engaged with shoe 54, tubing 40 through shoe 54 will support most of the weight of drill unit 200, with a small fraction of the weight transferred to cutter 70 via cutting apparatus 216. As a result, the elasticity of tubing 32 is essentially removed as a factor in the amount of cutting force applied. In this regard, the compression of biasing element 218 provided by the invention is important, as it will regulate at least most of the cutting force for penetrating the casing, and it will also compensate for differences between the length of cutting apparatus 216 (from motor 62 to the end of cutter 70), and the distance through passage 212, elbow 76, and the portion of annulus 214 between inner surface 196 and opening 198. For instance, if cutting apparatus 216 with biasing element 218 in its uncompressed state is 1.5 inches longer than the distance through the extension, sheath, elbow and annulus, biasing element 218 will be compressed by about that amount. Cutting apparatus 216 is thus essentially made self-adjusting in length.

Advantages of casing drill unit 200 of the invention include that the cutting force will be consistent and applied in a predictable manner, regardless of operator skill and well depth, so as to be at least generally uniform from hole to hole, to provide predictable and reliable casing penetration.

Figure 12:
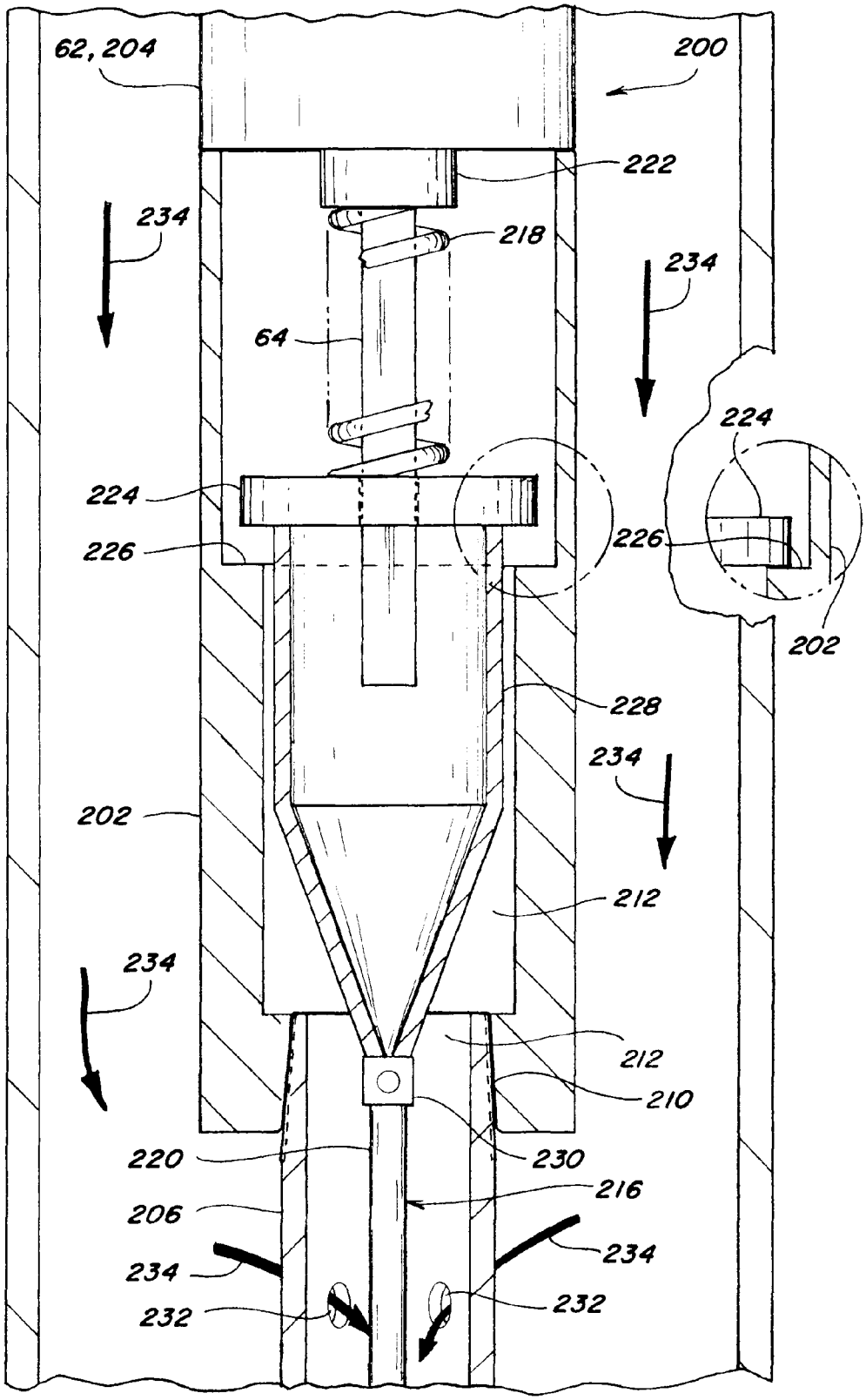
FIG. 12 is an enlarged fragmentary side view of the apparatus, in partial section to show aspects thereof.
Figure 13:
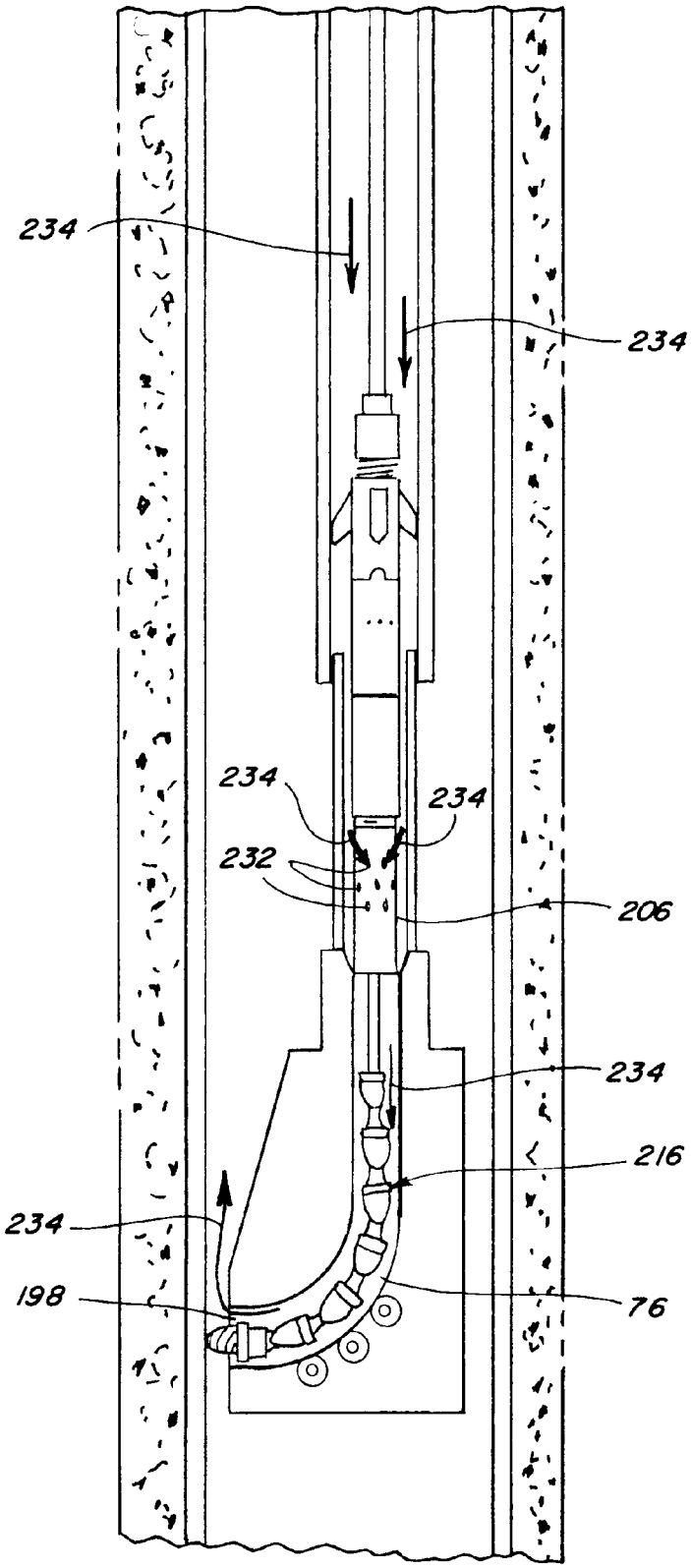
FIG. 13 is another enlarged fragmentary side view of the apparatus, in partial section, showing additional aspects, including discharge of a stream of gas or emulsion from the apparatus.

Referring more particularly to FIG. 12, according to a preferred embodiment of the invention, biasing element 218 comprises a compression spring, retained between an upper retainer 222 mounted about output shaft 64 for rotation therewith, and a lower retainer 224 which is mounted about output shaft 64 so as to be movable up and down thereon while rotatable therewith. Output shaft 64 preferably has a multi-sided sectional shape, for instance, square, and is received through holes through retainers 222 and 224 having a corresponding shape for retaining retainers 222 and 224 for rotation with shaft 64. Additionally, lower retainer 224 is configured, for instance, by being of sufficient sideward extent, so as to be capable of being captured or retained against downward movement by a shoulder 226 at a predetermined location on extension 202 within passage 212.

Lower retainer 224 additionally is suitably connected to or includes a cylindrical or other suitably shaped guide 228 extending downwardly and received in a marginally larger cylindrical or other shaped lower portion of extension 202 for limited up and down movement therein. Guide 228 has a lower end which is tapered to clear the upper end of sheath 206, and is preferably connected by a swivel joint 230, to the upper end of shaft extension 220. Swivel joint 230 facilitates insertion of cutter 70 and the universal joints into elbow 76. When cutter 70 is not in contact with inner surface 196 of casing 12 (FIG. 11), or otherwise separately supported, shaft extension 220, universal joints 68, and cutter 70 of cutting apparatus 216 are supported by swivel 230, guide 228, and shoulder 224, on extension 202, which, in turn, is supported by body 204 of motor 62.

When drill unit 200 is lowered through a well to bring cutter 70 into contact with surface 196 so as to exert a force thereagainst, this force will be translated through cutter 70, universal joints 68 shaft extension 220, and swivel 230, to guide 228 and thus lower retainer 224. Further downward movement of the drill unit 200 will then act to compress biasing element 218 by an amount about equal to the distance of movement. The spring constant or other measure of the resiliency of biasing element will largely determine the applied cutting force, and will preferably be selected such that drill unit 200 and tubing 32 will be mostly supported by shoe 54.

As another preferred aspect of the invention, it will be desired to direct a flow 234 of a pressurized fluid from laterally facing opening 198, including when lowering drill unit 200 through passage 212, and while drilling and performing other operations, e.g., acid injection and the like, to prevent entry of particulates and other solids through opening 198 into elbow 76. Flow 234 of the gas or emulsion can freely pass into elbow 76 when sheath 206 is being lowered, and sheath 206 includes at least one hole 232 therethrough for the passage of flow 234 into the sheath (illustrated by large black arrows 234 in FIG. 12), so as to pass into elbow 76, when the sheath is engaged with the shoe, so as to be discharged from at least laterally facing opening 198 in a manner for limiting entry of cuttings, particulates and other solids into the laterally facing opening and elbow. The gas or emulsion will preferably be pressurized at the surface using a compressor or the like, and pumped into tubing 40 for flow to elbow 75, either directly or through hole or holes 232.

The pressurized gas or emulsion will preferably be a compressed air, carbon dioxide, nitrogen or another inert gas, or a combination of these, and will be discharged during the cutting of the casing and also the drilling of the lateral passage through the formation. The gas or emulsion can also be used at other times, as required for maintaining the lateral opening and elbow clear of matter, for instance, when using an acid, and for clearing cuttings from extension 118 using a pressurized gas or the like as explained above. As an option, the pressurized gas or emulsion can also be discharged from one or more additional outlets, that can be located as desired or required, for directing the cuttings away from the lateral opening of the shoe, and more preferably upwardly from the shoe (FIGS. 10 and 13), so as to be carried by upward fluid flow to the surface of the well.

All of the gas or emulsion can be discharged from the shoe or the vicinity of the shoe, or some of it can be discharged from an orifice or orifices, at one or more higher locations within the well, for boosting the cuttings flow upwardly through the well, and also for reducing or removing the hydrostatic head within the well.

It will be understood that changes in the details, materials, steps, and arrangements of parts which have been described and illustrated to explain the nature of the invention will occur to and may be made by those skilled in the art upon a reading of this disclosure within the principles and scope of the invention. The foregoing description illustrates the preferred embodiments of the invention; however, concepts, as based upon the description, may be employed in other embodiments without departing from the scope of the invention. Accordingly, the following claims are intended to protect the invention broadly as well as in the specific form shown.

What is claimed is:

1. Apparatus for cutting a hole in a casing of a well, comprising:

a casing drill unit including a motor having a rotatable output element, and variable length cutting apparatus connected to the output element for rotation therewith including a resiliently compressible biasing element and at least one flexible element extending to and carrying a casing cutter, the drill unit having a weight, and the cutting apparatus having a predetermined overall length absent exertion of the weight of the drill unit thereagainst and being compressible in length by exertion of all or a portion of the weight of the drill unit thereagainst to compress the biasing element, the drill unit including a tubular element supported by and extending downwardly from the motor, the tubular element containing the output element of the motor and an upper end of the cutting apparatus including the biasing element for rotation within and relative to the tubular element, the tubular element having a fixed length shorter than the predetermined overall length of the cutting apparatus such that a lower portion of the cutting apparatus extends downwardly below the tubular element;

the drill unit being configured to be suspended in and lowered through an interior cavity of a casing of a well to move the casing cutter and the flexible element through a curved passage through a down hole unit disposed at a predetermined depth within the interior cavity such that the casing cutter extends laterally outwardly from a lateral opening of the passage and until a lower end of the tubular element engages the down hole unit to form a fixed length passage extending from the motor through the curved passage to the lateral opening, the predetermined overall length of the cutting apparatus being a predetermined amount greater than the fixed length passage such that the casing cutter will contact a side surface of the casing opposite the lateral opening prior to the engagement of the lower end of the tubular element with the down hole unit, to transfer a fraction of the weight of the drill unit to the cutting apparatus to compress the resiliently compressible biasing element for resiliently urging the cutter against the interior side surface of the casing to advance the cutter into the casing as the casing is cut.

2. Apparatus of claim 1, wherein the predetermined overall length of the cutting apparatus is about 1.5 inch greater than the fixed length passage.

3. Apparatus of claim 1, further comprising apparatus for directing a flow of a gas or an emulsion through the passage of the down hole unit and the lateral opening about the cutting apparatus and into the interior cavity, to prevent entry of cuttings and other solids into the passage.

4. Apparatus of claim 3, wherein the tubular element forms a sealed condition with the down hole unit when engaged therewith and comprises at least one passage for the flow of the gas or emulsion into the passage of the down hole unit.

5. Apparatus of claim 3, further comprising an element suspending the drill unit in the interior cavity of the well, comprising a tube located within a larger tube, and wherein the larger tube has as interior cavity in communication with the at least one passage of the tubular element that carries the pressurized gas or emulsion to the at least one passage of the tubular element.

6. Apparatus of claim 1, wherein the biasing element comprises a spring.

7. Apparatus of claim 6, wherein the spring connects the at least one flexible element to the rotatable output element of the motor, for rotating the at least one flexible element and the cutter.

8. Apparatus of claim 1, wherein the at least one flexible element comprises a universal joint.

9. A method for cutting a hole in a casing of a well, comprising steps of:

providing a down hole unit at a predetermined depth within an interior cavity of the casing of the well, the down hole unit having a curved passage extending downwardly therethough to a lateral opening facing an interior side surface of the casing; and providing a casing cutting apparatus including a casing cutter connected to at least one flexible element and a resiliently compressible biasing element, connected to a rotatable output element on a lower end of a motor of a casing drill unit suspended in and extending downwardly within the interior cavity of the well, the drill unit having a weight, and the casing cutting apparatus having a predetermined overall length when the biasing element is in an uncompressed state which is greater than a combination of a distance through the curved passage and a tubular element suspended from the motor and containing an upper portion of the cutting apparatus, the tubular element being engageable with the down hole unit for holding the motor a predetermined distance thereabove; then lowering the casing drill unit in the interior cavity to lower the casing cutter and the flexible element in the curved passage through the down hole unit disposed at the predetermined depth within the interior cavity such that the casing cutter extends laterally outwardly from the lateral opening of the passage;

further lowering the drill unit to contact the casing cutter with the side surface of the casing such that at least a portion of the weight of the drill unit is exerted against the cutting apparatus to compress the resiliently compressible biasing element for resiliently urging the cutter against the interior side surface of the casing, and bringing the tubular element into engagement with the down hole unit; and then operating the cutter to cut the casing while the resiliently compressible biasing element is compressed so as to resiliently urge the cutter against the interior side surface of the casing of the well for advancing the cutter into the casing as the casing is cut.

10. The method of claim 9, wherein the tubular element forms a sealed condition with the down hole unit.

11. The method of claim 10, further comprising directing a flow of a gas or an emulsion through the tubular element and into and through the passage of the down hole unit and through the lateral opening about the cutting apparatus and into the interior cavity, to prevent entry of cuttings and other solids into the passage.

12. The method of claim 11, wherein the tubular element is connected in communication with a source of pressurized gas or emulsion and is configured for directing the flow of the gas or emulsion into the passage of the down hole unit.

13. The method of claim 11, wherein the drill unit is suspended in the interior cavity of the well by a tube located within a larger tube, and wherein the larger tube carries the pressurized gas or emulsion.

14. The method of claim 9, wherein the biasing element comprises a spring.

15. The method of claim 14, wherein the spring connects the at least one flexible element to the rotatable output element of the motor, for rotating the at least one flexible element and the cutter.

16. The method of claim 9, wherein the at least one flexible element comprises a universal joint.

* * * * *